US005683291A

United States Patent [19]

Humpert et al.

[11] Patent Number: 5,683,291

[45] Date of Patent: Nov. 4, 1997

[54] DEVICE FOR SURFACE MACHINING OF WORKPIECES

[75] Inventors: Richard Humpert; Wolfgang Winkelmann, both of Wolfach, Germany

[73] Assignee: Maschinenbau Grieshaber GmbH & Co., Bad Rippoldsau-Schapbach, Germany

[21] Appl. No.: 508,320

[22] Filed: Jul. 27, 1995

[30] Foreign Application Priority Data

Jul. 29, 1994 [DE] Germany ..... 44 26 923.4

[51] Int. Cl.[6] ..... B24B 7/00; B24B 9/00

[52] U.S. Cl. ..... 451/168; 451/173; 451/8; 451/49; 451/317

[58] Field of Search ..... 451/313, 314, 451/317, 168, 173, 461, 526, 540, 49, 311, 8

[56] References Cited

U.S. PATENT DOCUMENTS

| | | | |
|---|---|---|---|
| 1,908,048 | 5/1933 | Player et al. | 451/317 |
| 4,773,187 | 9/1988 | Ohta et al. | 451/49 |
| 4,993,191 | 2/1991 | Judge et al. | 451/317 |
| 5,018,311 | 5/1991 | Malagrino, Jr. et al. | 51/140 |
| 5,058,325 | 10/1991 | Pineau | 451/317 |
| 5,251,404 | 10/1993 | Wasserbaech | 451/311 |
| 5,437,125 | 8/1995 | Barton, II | 451/317 |
| 5,472,368 | 12/1995 | Zollig | 451/8 |
| 5,490,808 | 2/1996 | Jantschek et al. | 451/168 |
| 5,536,201 | 7/1996 | Winkelmann | 451/168 |

FOREIGN PATENT DOCUMENTS

| | | |
|---|---|---|
| 0 413 165 A2 | 2/1991 | European Pat. Off. . |
| 2 279 280 | 1/1995 | United Kingdom . |

*Primary Examiner*—Robert A. Rose
*Assistant Examiner*—George Nguyen
*Attorney, Agent, or Firm*—Jones, Tullar & Cooper, P.C.

[57] ABSTRACT

A device and process for the surface machining of workpieces with convex surfaces, the device including an abrasive belt, abrasive belt clamping devices, an abrasive belt tensioning device, and clamping tongs device with two clamping arms, one of which is rotatable relative to the other. A section of unused abrasive belt is drawn from a supply roll for the abrasive belt and a corresponding section of used abrasive belt is wound onto a wind-up roll for the abrasive belt so that machining proceeds with a new section of abrasive belt.

14 Claims, 4 Drawing Sheets

DEVICE FOR SURFACE MACHINING OF WORKPIECES

BACKGROUND OF THE INVENTION

The present invention relates to a device for the surface machining of workpieces with convex surfaces by means of an abrasive belt, according to which a fresh abrasive belt is introduced to the surface of the workpiece to be machined by means of a conveyor device, and the surface of the workpiece to be machined is surrounded by a clamping tongs device, featuring two clamping arms, at least one of which is mounted on bearings such that it is capable of swivelling, with the result that the clamping arms of the clamping tongs are capable of performing a closure movement. The clamping arms are provided with clamping blocks, at least one of which is in contact by means of the abrasive belt with the surface of the workpiece to be machined.

In order to carry out extremely fine machining of radial bearings, for example of a crank shaft or of the bearing mounts of connecting rods on a crankshaft, a super-finishing machine with super-finishing blocks or an abrasive belt is used. In this context, the blocks feature a profiled surface, which corresponds to the surface which is to be machined. With the use of an abrasive belt, the belt is pressed onto the point of the workpiece which is to be machined by means of a contact pressure block with an appropriate profile, this belt then removing material from the workpiece. The relative movement between the workpiece and the tool is brought about by the fact that the workpiece is subjected to a rotational movement, and, if possible, to an oscillation motion. This latter superimposed motion creates the possibility of a cross-hatch grinding effect. Because of the partial wrap of the surface to be machined, the abrasive belt is in contact with the surface which is to be machined across a specific circumference angle. The abrasive belt is, however, very rapidly used up, since the abrasive grains break away from the adhesive bind after a very short period of time, with the result that the abrasive effect of the abrasive belt in this area rapidly decreases, and then becomes inadequate. The abrasive belt is also known to become contaminated with dirt adhering to the surface of the shaft which is to be machined, and by transferred material, with the result that the free spaces between the abrasive grains become clogged, and the cutting effect is substantially reduced. As a role, the abrasive belt becomes unusable due to this dirt contamination, even leading to the destruction of the surface which is to be created. When an abrasive belt is being used, therefore, it must be moved forwards by a certain amount, in order for an area with fresh, unused grains to be introduced to the area to be machined.

In order to move the abrasive belt onwards, provision is made for belt conveyor devices, which move the belt onwards either continuously or in steps or lengths. These belt conveyor devices are equipped either with electric motors or with a stepped switching mechanism, with the result that, when a new shaft is inserted into the machining device, and in particular when the clamping arms of the clamping tongs are opened or closed, the belt is moved onwards by a certain amount. Step switching devices of this nature do, however, have the disadvantage that they do not move the belt onwards during the grinding process, something which is necessary in particular when larger bearing points are being machined, because in such cases the abrasive belt wears out rapidly. This problem is resolved at the present time by the abrasive belt being raised off the surface which is to be machined during machining, when the clamping tongs are opened, in order to move forwards by the distance desired, and then being placed back on the premachined point. To do this, however, it is absolutely essential that the crankshaft adopts a quite specific rotational position, in order for the clamping tongs to be opened. This procedure is, however, extremely time-consuming, as a result of which the entire machining process demands a very great deal of time. In addition to this, the desired super-finish result is not achieved, because the removal of material is not continuous.

SUMMARY OF THE INVENTION

The present invention is accordingly based on the object of further developing a device for surface machining of the type referred to above, in such a way that the surface machining of workpieces with convex surfaces can be carried out more simply and more rapidly.

This object achieved according to the present invention by the fact that the belt conveying device is provided with two belt clamping devices, one of which is arranged in the belt conveying device in front of the part of the workpiece which is to be machined, and the other behind it, and that provision is made, between the belt clamping devices, for a belt clamping device which imposes tension on the abrasive belt.

The effect of the two belt clamping devices is that the abrasive belt is defined and held secure against slippage, so that it can be placed in contact with the surface which is to be machined on the workpiece, and can be pressed into contact by the clamping blocks which pertain to it. The belt clamping devices are provided, in this context, for preference at the belt intake and at the belt outlet respectively. By means of the belt tensioning device, the section of the abrasive belt located between the two belt clamping devices is subjected to tension in such a way that the abrasive belt is imposed in contact with the surface to be machined, irrespective of the direction of rotation of the workpiece, in which context the direction of rotation may change during machining.

Preferably, the belt tensioning device is designed as a spring-loaded, hydraulically, or pneumatically-actuated deflection pulley. By means of the spring force or the hydraulic or pneumatic pressure, a specific force is exerted on the deflection pulley, which is transferred by the pulley onto the abrasive belt, causing the abrasive belt to be tensioned. The pressure, or the spring force, is selected in such a way in this context that the abrasive belt is under tension, but there is still an adequate degree of security against belt tear. The belt tensioning device is capable of being moved between a position of rest and an operating position, in which case the belt tensioning device is preferably displaced by the abrasive belt into the operating position, i.e. into the pretensioned position.

This advantageous embodiment makes provision for the adjustment path between the position of rest and the operating position of the belt tensioning device corresponding to the section on the abrasive belt which will be worn away during a machining process, or is slightly larger than this section. Because of the displacement of the belt tensioning device from the pretensioned position into the position of rest, a corresponding section of fresh abrasive belt can be drawn out of the supply container or the supply roll, with the result that a corresponding section of the surface to be machined can be moved into position, By means of the on-off actuation of the belt tensioning device, then, it is possible for the used section to be replaced by a new section of the abrasive belt.

Preferably, at least one belt clamping device is designed as a hydraulic, electro-magnetic, or pneumatic clamping device. In the case of hydraulic belt clamping devices, it is of advantage if the hydraulic system of the abrading device can be used jointly, so that no additional equipment is required but only hose lines and valves. The same applies accordingly for pneumatic belt clamping devices, if the grinding machine is already supplied with compressed air.

Preferably, at least one clamping block is equipped with hard shell elements, which press the abrasive belt onto the surface which is to be machined. Naturally, the abrasive belt can also be conducted across both clamping blocks, in which context these clamping blocks are then formed from a hard material or an elastic material, such as vulkollan. If only one clamping block is used for the machining process, then the other clamping block can be provided with a measuring device, with which the measurement of the thickness, roundness, surface quality, or similar characteristics can be carried out during the machining process.

The noted object is also achieved by means of a process in which the surface which is to be machined on the workpiece is machined by means of an abrasive belt, which is pressed onto the surface with a specific force, and the used section of the belt is replaced by an unused section, in such a way that the abrasive belt is moved onwards by at least the length of this section, in which situation the abrasive belt is clamped during the machining of the workpiece both in front of the workpiece and behind it, and in which context the contact pressure force is reduced after an initial machining stage, the rear belt clamping arrangement is released, a predetermined section of unused abrasive belt is drawn off the supply roll, the rear belt clamping arrangement is activated, the front clamp is released, the abrasive belt is wound up onto a take-up roll by the length of the predetermined section and tensioned between both belt clamps, the front belt clamp is activated, the contact pressure is increased, and the next machining stage is then carried out.

This process has the considerable advantage that, during the machining process, new, i.e. unused abrasive belt can be drawn out without the crankshaft having to be brought to a standstill, so that the individual machining stages can follow directly one after another. During one complete machining process, fresh, unused abrasive belt can be drawn out once or several times. To do this, all that is required is for the contact pressure of the abrasive belt to be reduced on the surface which is to be machined, so that the abrasive belt can be drawn through between the contact pressure block and the workpiece without any difficulty.

Advantageously, during this process, the crankshaft rotates in a direction of rotation which supports the passage of the abrasive belt. The direction of rotation in this case corresponds to the conveying direction of the abrasive belt.

It is of advantage for the abrasive belt always to be drawn through whenever a specific draw-off rate per time unit is undercut. This moment is determined, for example, by means of a control unit, which is connected to a measuring device which engages at the pan of the workpiece which is to be machined. The measuring device determines, for example, the current radius or diameter of the beating position of the crankshaft which is being machined at that particular moment. In this way, the abrasive belt can be used to the best possible effect. Provision is made, in any event, that, at the beginning of each individual machining process, a abrasive belt is used.

In another embodiment, provision is made for the duration of a machining section to be determined beforehand empirically, and for the empirically determined value to be set at the machining device. This has the advantage that, during processing of the workpiece, fresh abrasive belt is drawn out at all the machining points simultaneously; i.e. the individual clamping tongs are in each case actuated simultaneously, with the result that a large number of control elements can be spared. The end of the machining process can be determined, for example, by means of a measuring device, in which case the effect of the measuring device is solely that the contact pressure of the abrasive belt is raised. As soon as the last point to be machined has been completed, the crankshaft is moved into the transition position, the clamping tongs are opened, and the crankshaft is removed from the machining station.

DESCRIPTION OF THE DRAWINGS

Further advantages, features, and details of the present invention are set out in the following description, in which several embodiments are presented in detail, by reference to the drawings. These show.

DETAILED DESCRIPTION

Figure 1:
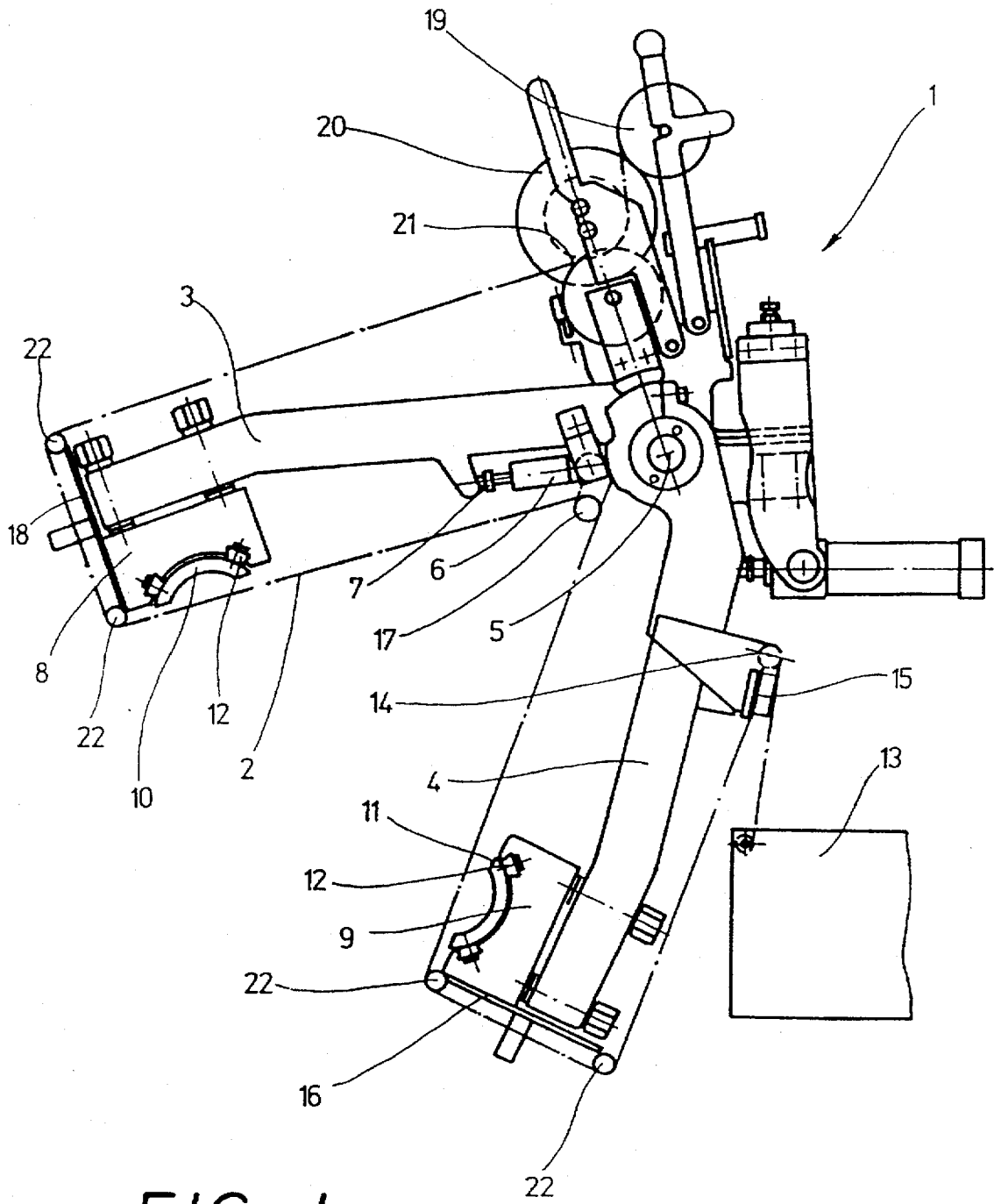
FIG. 1 which is an open clamping device, in which the abrasive belt is conducted across two clamping blocks of two clamping arms.

FIG. 1 shows one embodiment of a device 1 according to the present invention, for the surface machining of a workpiece by means of an abrasive belt 2. The device 1 consists essentially of two clamping arms 3 and 4, which are mounted on a bearing 5 in such a way as to be capable of swivelling, and can be opened and closed in the manner of tongs. The two clamping arms 3 and 4 are opened in such a way that a pneumatic or hydraulic cylinder 6 has pressure imposed upon it, and is turned in a clockwise direction by means of a piston rod 7 of the clamping arm 3 moving outwards. The two clamping arms 3 and 4 feature clamping blocks 8 and 9 on their free ends, on which contact pressure blocks 10 and 11 are provided. The contact pressure blocks 10 and 11 are designed as hemispherical shells with a contact angle of about 90°, and consist, for example, of a hard material. The contact pressure blocks 10 and 11 are supported on the clamping blocks 8 and 9 by means of elastic inserts 12, made, for example, of vulkollan.

The abrasive belt 2 is wound onto a supply roll, not illustrated, which is accommodated in a roll box (supply roll) and drawn off 13. The abrasive belt 2 is, in this context, guided from the roll box 13 across a deflection pulley 14, a belt clamping device 15, and a belt guide 16 into the area of the contact pressure block 11. From there, the abrasive belt 2 extends around a further deflection pulley 17, which is provided in the area of the bearing 5, to the contact pressure block 10 of the clamping block 8. From there, it runs through another belt guide 18, and passes into the wind-up area with the wind-up roll 19 and drive unit 20, with a second belt clamping device 21. The abrasive belt 2 is conducted around the two belt guides 16 and 18 and around deflection rollers 22. The design of the drive 20, with the second belt clamping device 21, is shown more clearly in FIGS. 3 and 4, in which these elements are explained in greater detail.

If, for example, the bearings of a crankshaft are inserted in the device shown in FIG. 1, then the two clamping arms 3 and 4 are closed in the direction of the clamping arm 4, by the turning of the clamping arm 3, so that the two contact pressure blocks 10 and 11 rest on the bearing of the crankshaft which is to be machined. In this situation, the abrasive belt 2, or the sections of the abrasive belt 2, located in the area of the contact pressure blocks 10 and 11, will be pressed onto the convex surface of the workpiece which is to be machined. By means of rotation, and, if necessary, an oscillatory motion taking effect in the axial direction of the workpiece, the surface of the bearing will be finished. After a predetermined period of time, the belt clamping device 15 will be released, or relaxed. In this situation, the contact pressure roll (deflection pulley) 17, which holds the abrasive belt under tension, and is itself under pretension, moves radially in the direction onto the bearing 5, or substantially in this direction, as a result of the prestressing force, and draws a section of the new abrasive belt 2 out of the roll box 13. Because the belt tensioning device 15 is relaxed, or has been opened, the abrasive belt 2 can slide through unimpeded, and the used section, which is located in the area of the contact pressure block 11, is replaced by an unused section. After this process, the belt clamping device 15 closes, and holds the abrasive belt securely. The drive unit 20 is now activated and the abrasive belt 2 is wound up by a predetermined amount onto the wind-up roll 19. In this context, the belt section which is used up during the previous machining section is drawn out of the area of the contact pressure block 10, and a fresh belt section, which is located between the clamping block 8 and the deflection pulley 17, is drawn on into the area of the contact pressure block 10. During this process, the deflection pulley 17 again moves away from the bearing 5, and is put under preliminary tension. If the deflection pulley 17 reaches its maximum operating position, the drive unit 20 stops, and the abrasive belt 2 is held securely by the second belt clamping device 21. The deflection pulley 17 keeps the end of the belt 2 under tension, with the result that the bearing position which is to be machined wraps under pre-tension. By means of the process described above, the abrasive belt is drawn out section by section, in which context the used section of the abrasive belt is replaced by a new, unused section. This process can take place during the machining of the crankshaft, for which it is not necessary for the crankshaft to be stopped. All that is required is for the contact pressure force of the two clamping arms 3 and 4 to be relaxed on the workpiece, and increased again after the belt has been drawn out.

The drawing out of a new section of abrasive belt 2, in which the used sections are replaced at the clamping blocks 8 and 9, there is no requirement for the two clamping arms 3 and 4 to open; instead, all that is necessary is for the contact pressure of the clamping arms 3 and 4 to be relaxed, so that the abrasive belt 2 can be drawn through between workpiece and contact pressure blocks 10 and 11. It is therefore possible for the abrasive belt 2 to be drawn on while the workpiece is being machined, in which situation the rotary movement of the workpiece does not need to be interrupted. In other words, this means that the workpiece does not need to be stopped and moved into a specified zero position, that the clamping tongs do not, as is otherwise usual, need to be opened and closed again, and that the workpiece does not have to be moved in once again.

Advantageously, the drawing of a new section of abrasive belt 2 takes place automatically after a specified machining period.

Advantageously, the deflection pulley 17 is located at such a distance from the two contact pressure blocks 10 and 11, and the contact angle or wrap of the two contact pressure blocks 10 and 11 is selected in such a way that, when the abrasive belt 2 is drawn on, the abrasive belt 2 is always drawn on by double the extent of the contact angle, in which context a section with fresh abrasive belt comes into contact in the area of the contact pressure block 10. This means that the interval between the two contact pressure blocks 10 and 11, in which the deflection pulley 17 is located, is a multiple of the doubled contact angle of a contact pressure block. This design guarantees that fresh abrasive belt 2 is always conducted to the machining point of the contact pressure block 10 at each belt feed.

Figure 2:
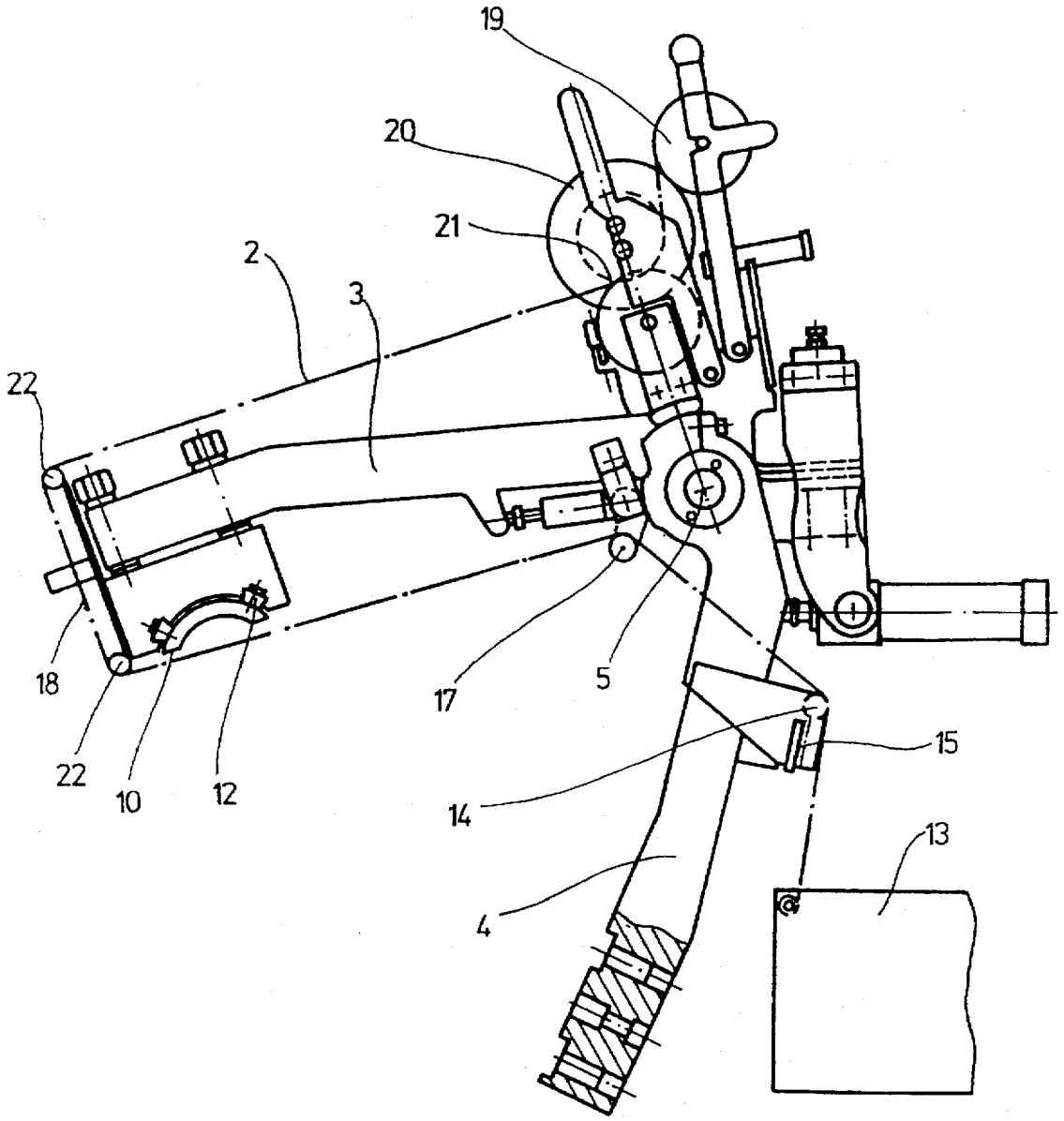
FIG. 2 which is an open clamping device, in which the abrasive belt is conducted across a block of one clamping tong element, and the other clamping tong is designed for accommodating, for example, a motor device.

In another embodiment of the present invention, which is shown in FIG. 2, the belt feed is not carried out after a predetermined machining time has elapsed, but when a predetermined machining rate, i.e. diameter changes per time unit, is undercut. The diameter change is determined by means of a measuring device 23, shown in FIGS. 3 and 4, which can be secured at the free end of the clamping arm 4. For this purpose, the free end of the clamping arm 4 features special accommodation devices, to which the measuring device 23 can be screwed and adjusted. This measuring device 23 is used during the machining process to measure the diameter of the bearing, and the abrading rate can be determined. In the case of a fresh abrasive belt 2, a high abrading rate is achieved, which decreases as machining progresses. This is attributable to the fact that the abrasive belt 2 becomes clogged with abraded material, and grinding gains break off during machining. If the change in diameter drops, within a specific period, below a predetermined value, then a fresh abrasive belt 2 will be drawn out, which occurs during machining. To do this, all that is required, as already mentioned above, is for the contact pressure of the two damping arms 3 and 4 to be reduced on the surface of the workpiece which is to be machined to such an extent that the abrasive belt 2 can be drawn through. If there is a fresh section of abrasive belt 2 at the surface of the workpiece which is to be machined, then the contact pressure is increased to the prescribed value, and machining continues.

With this embodiment according to FIG. 2, the abrasive belt 2 is conducted directly from the deflection pulley 14 directly to the deflection pulley 17. The belt draw in this embodiment, at each step, amounts to exactly the contact angle of the contact pressure block 10. At each belt draw, then, the section of abrasive belt 2 which follows directly on the used section is conducted to the contact pressure block 10.

Figure 3:
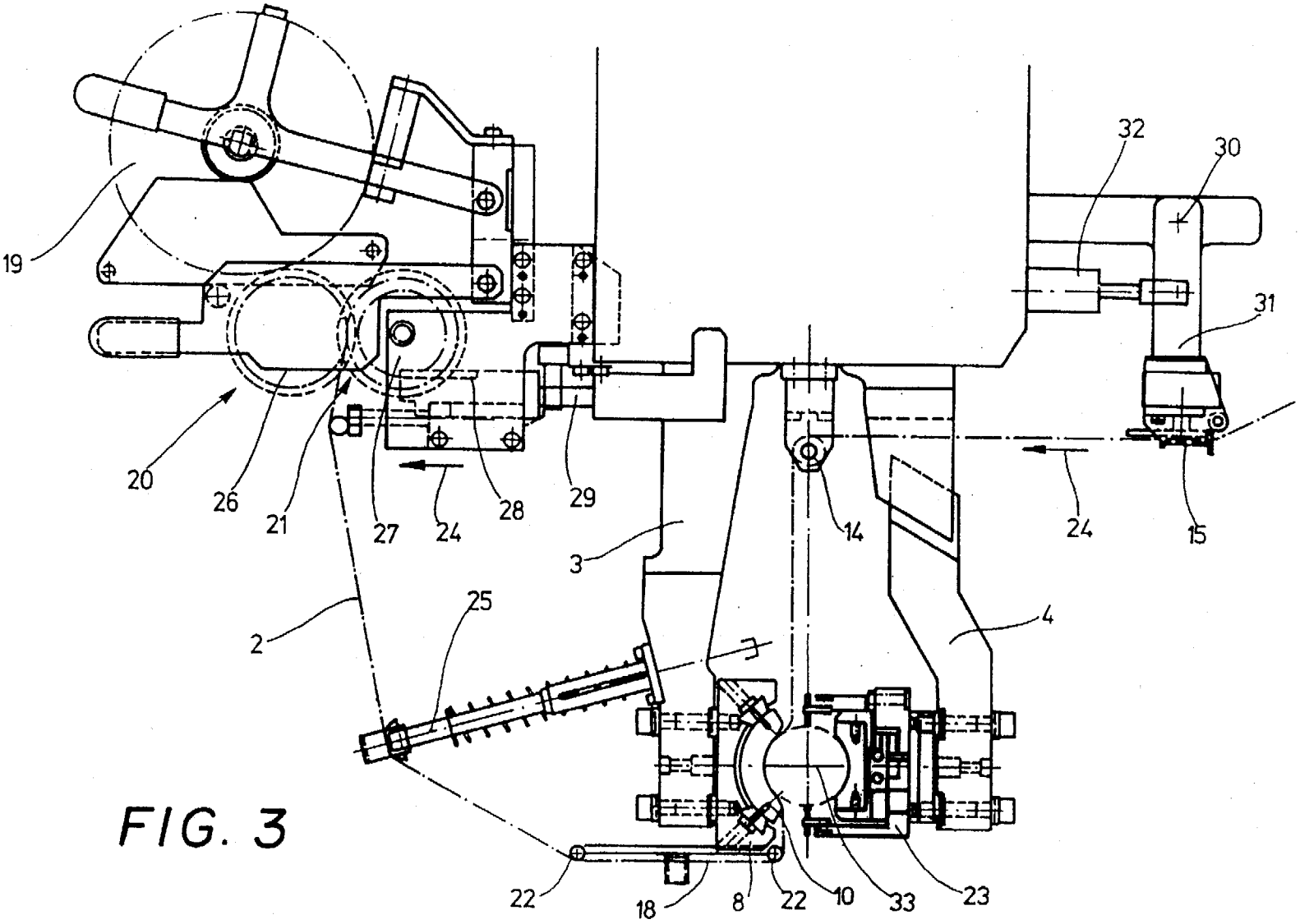
FIGS. 3 and 4 which shown a device with closed clamping tongs, in which case a measuring device has been arranged for measuring diameter.

The embodiment shown in FIG. 3 corresponds essentially to the embodiment of FIG. 2, in which context a measuring device 23 is shown here for measuring the diameter of the workpiece. The abrasive belt 2, which is conveyed in the direction of the arrow 24, is drawn off a supply roll, not shown, and conducted in the direction of the wind-up roll 19 via the belt clamping device 15, the deflection pulley 14, the contact pressure block, the manual guide element 18 with the two deflection pulleys 22, and a unit 25 for monitoring belt tear. In this situation, the belt 2 runs through the drive unit 20, which consists of two toothed wheels 26 and 27, which form the second belt clamping device 21. The abrasive belt 2 is held securely by the teeth of the two toothed wheels 26 and 27, which engage with one another, and is moved in the direction of the arrow 24. The drive unit 20 also features a toothed bar 28, which engages with a second toothed rim of the toothed wheel 27. The toothed bar 28 is provided for on the end of a piston 29 of a pneumatic or hydraulic cylinder, and is driven by this cylinder in the direction of the arrow 24. By means of the toothed bar 28, which engages with the toothed wheel 27, which in turn engages with the toothed wheel 26, the abrasive belt 2 is drawn out by the specific deflection distance.

If the section of abrasive belt 2 which is located in the area of the contact pressure block 10 is used up, the belt clamping device 15 is released, so that this device is swivelled by the distance of one bearing 30 in a counter-clockwise direction by means of the pre-tensioned piston-cylinder unit 32. The belt clamping device 15 is then closed again, and the abrasive belt 2 is clamped. The piston 29 is then actuated, and the abrasive belt 2 is drawn through by a section length, which corresponds to the contact angle of the contact pressure block 10, or is slightly less. In this situation, the belt clamping device 15 is also moved in the direction of the arrow 24, and the arm 31, which is rotatably mounted around the beating 30, subjects the piston-cylinder unit 32 to preliminary tension, inasmuch as the piston is being pressed against a specific force into the cylinder. The force in this context is selected in such a way that a belt tear can be reliably excluded. If the abrasive belt 2 is drawn through by the prescribed amount, the drive unit 20 is stopped and the belt is kept taut.

Figure 4:
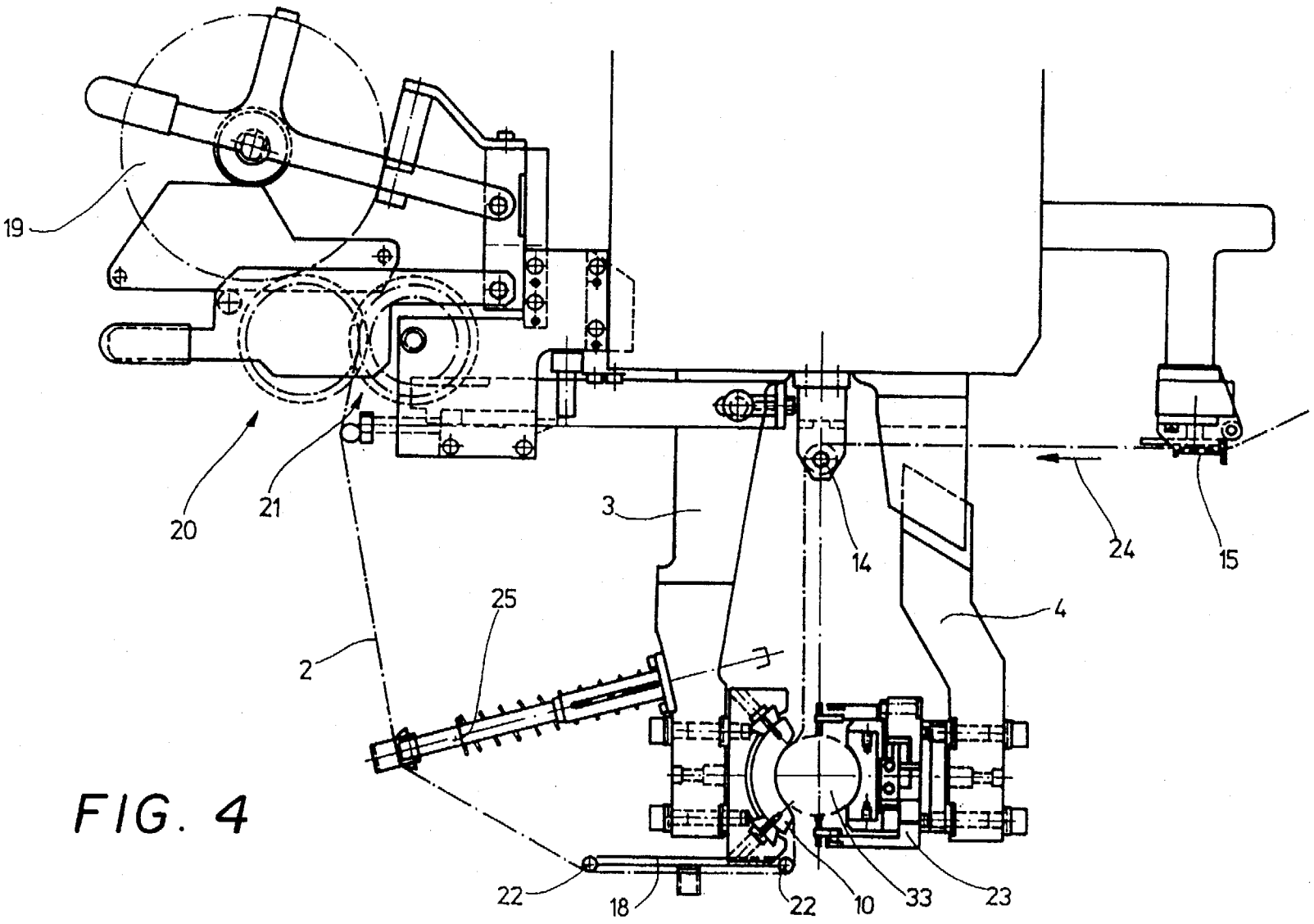

With the embodiment in FIG. 4, the belt clamping device 15 is designed in such a way that the abrasive belt 2 may be kept taut during machining, but can slip through the open belt clamping device 15 when the belt is being drawn through.

With the embodiments of FIGS. 3 and 4, the belt is also drawn through without the two clamping arms 3 and 4 being opened, in that the contact pressure force of the arms 3 and 4 onto the workpiece 33 is reduced.

In order to avoid opening of the device and then reclosing at when the belt is drawn through in order to renew the belt section at the machining point, and also in order to avoid the workpiece needing to be set into a zero position, the possibility is created of the workpiece being machined almost continuously. In addition to an improved surface enhancement, and optimised diameter distribution, a reduction in machining time is also achieved.

We claim:

1. A device for the surface machining of workpieces with convex surfaces, comprising:

an abrasive belt which defines a feeding direction from a supply roll to a wind-up roll;

a clamping tongs device having two clamping arms, with at least one of said clamping arms being mounted to be rotatable relative to said other clamping arm, and with at least one of said clamping arms having a clamping block at one end thereof for engaging said abrasive belt and applying said abrasive belt to the surface of the workpiece to be machined;

an abrasive belt feeding device including two abrasive belt clamping devices, each located adjacent a respective one of said clamping arms, and with one of said abrasive belt clamping devices also located in the feeding direction of said abrasive belt; and a belt tensioning device located between said abrasive belt clamping devices, which engages and applies tension to said abrasive belt;

wherein a section of unused abrasive belt is drawn from a supply roll under the influence of said belt tensioning device when said abrasive belt clamping device located in the feeding direction of said abrasive belt releases said abrasive belt, and wherein said abrasive belt pre-tensions said belt tensioning device when said abrasive belt clamping device located in the feeding direction of said abrasive belt and adjacent the supply roll is closed and said abrasive belt is released by the other of said abrasive belt clamping device located adjacent the wind-up roll.

2. A device according to claim 1, wherein said belt tensioning device tautens said abrasive belt between said two clamping arms.

3. A device according to claim 1, wherein said belt tensioning device as comprises a spring loaded deflector pulley.

4. A device according to claim 1, wherein said belt tensioning device defines an adjustment path between its rest position and its tensioned position, which corresponds to a length of said abrasive belt, which in turn corresponds to at least the circumferential distance of the surface of the workpiece which is to be machined.

5. A device according to claim 1, wherein said belt tensioning device comprises an electro-magnetic tensioning device.

6. A device according to claim 1 wherein said clamping block is fitted with hard shells, which press said abrasive belt onto the surface of the workpiece to be machined.

7. A device according to claim 1, wherein said abrasive belt is held taut between said belt clamping devices by said belt tensioning device.

8. A device according to claim 1, further comprising: means for driving the workpiece in both directions of rotation during machining.

9. A device according to claim 1, further comprising: means for subjecting the workpiece to an axial oscillation movement during machining.

10. A device according to claim 1, wherein said belt tensioning device comprises an hydraulically actuated deflector pulley.

11. A device according to claim 1, wherein said belt tensioning device comprises a pneumatically actuated deflector pulley.

12. A process for the surface machining of workpieces with convex surfaces by means of an abrasive belt and a front and rear abrasive belt clamp, the abrasive belt moving from a supply roll to a wind-up roll, comprising the steps of:

bringing the abrasive belt into contact with the convex surface of the workpiece by activating the front and rear abrasive belt clamps;

pressing the abrasive belt against the contacted convex surface for machining;

reducing the pressing force, releasing the rear abrasive belt clamp, drawing an unused section of abrasive belt from the supply roll, and activating the rear abrasive belt clamp; and releasing the front abrasive belt clamp, winding-up a corresponding section of used abrasive belt onto the wind-up roll, tautening the abrasive belt between the abrasive belt clamps, activating the front abrasive belt clamp, and pressing the abrasive belt once again against the contacted convex surface of the workpiece for machining.

13. A process according to claim 12, wherein the drawing of the unused abrasive belt is controlled by means of a monitoring device which engages at the surface of the workpiece which is to be machined.

14. A process according to claim 12, further comprising the step of: empirically determining the duration of a machining stage; and setting the value of said duration at the machining device.

* * * * *